US005893479A

United States Patent [19]

Berberat

[11] Patent Number: 5,893,479

[45] Date of Patent: Apr. 13, 1999

[54] STORAGE TANK VAULT

[76] Inventor: Henry Berberat, 83 Union City Rd., Prospect, Conn. 06712

[21] Appl. No.: 08/895,660

[22] Filed: Jul. 17, 1997

[51] Int. Cl.[6] ..... B65D 90/24

[52] U.S. Cl. ..... 220/567; 220/571; 220/560.03; 220/567.2

[58] Field of Search ..... 220/571, 565, 220/567, 567.2, 560.03, 572, 573, 567.1, 562, 581, 23.83, 23.86, 23.87, 23.88, 23.89, 23.9, 23.91, 62.15, 614, 610, 681, 626, 627, 918, 919, 253, 256

[56] References Cited

U.S. PATENT DOCUMENTS

| | | | |
|---|---|---|---|
| 408,169 | 7/1889 | Dunn . | |
| 809,897 | 1/1906 | Bending . | |
| 911,027 | 2/1909 | Bratton . | |
| 2,121,363 | 6/1938 | Myers . | |
| 2,944,563 | 7/1960 | De Blasio et al. . | |
| 4,154,031 | 5/1979 | Williamson et al. . | |
| 4,519,415 | 5/1985 | Carn | 220/565 |
| 4,584,802 | 4/1986 | Casselman et al. | 220/565 |
| 5,071,166 | 12/1991 | Marino . | |
| 5,495,695 | 3/1996 | Elliott, Jr. | 220/565 |
| 5,555,999 | 9/1996 | Wilcox . | |
| 5,570,714 | 11/1996 | Magish | 220/560.03 |
| 5,601,204 | 2/1997 | Hall . | |
| 5,664,696 | 9/1997 | Canga | 220/560.03 |
| 5,711,632 | 1/1998 | Garrahan | 220/565 |
| 5,778,608 | 7/1998 | Elliott, Jr. | 220/565 |

*Primary Examiner*—Stephen Castellano
*Attorney, Agent, or Firm*—Pepe & Hazard LLP

[57] ABSTRACT

An above ground liquid holding tank installation includes an inner tank nested within a rigid enclosure. An open bottomed precast concrete vault encloses both the enclosure and the inner tank. The enclosure contains any leakage or spills from the tank. The vault protects the tank and the enclosure against detrimental external forces while providing access for inspection, maintenance and replacement thereof.

14 Claims, 4 Drawing Sheets

STORAGE TANK VAULT

BACKGROUND OF THE INVENTION

The present invention relates to a secure and environmentally safe tank installation for holding liquids, and more particularly, to a concrete protective vault for use with a liquid storage tank.

Many hazardous (including highly flammable) or noxious liquids are stored in above-ground holding tanks. Environmental and safety considerations require that leakage from such tanks be avoided, and that any accidental leakage be securely contained. In addition, the tanks may be exposed to a number of detrimental external forces, such as fire, weather, projectiles, physical impact and vandalism, against which they should desirably be protected. Such protection, however, must not be achieved in a way which obstructs access to the tank for operation, inspection and maintenance, or which prevents replacement if this becomes necessary.

Accordingly, it is an object of the present invention to provide a novel, secure and environmentally safe liquid holding tank installation.

It is also an object to provide such a liquid holding tank installation which may be readily fabricated and which effectively insures against leakage.

It is another object to provide such a liquid holding tank installation which offers protection against detrimental external forces while providing access for inspection, maintenance, and replacement.

It is yet another object to provide a convenient and effective means of protecting existing or conventional tanks against such external forces.

SUMMARY OF THE INVENTION

It has now been found that the foregoing and related objects and advantages may be readily attained in a liquid holding tank installation which includes an inner tank, which may be double walled, having end walls and a peripheral wall. A rigid enclosure extends about the tank and has a base wall, end walls and side walls and at least the end and side walls are spaced outwardly from the ends walls and peripheral wall of the inner tank to provide a compartment therebetween. The inner tank is supported within the enclosure in its spaced relation by first support elements. The enclosure, in turn, is supported upon a base.

A precast concrete vault, resting on the base, encloses both the enclosure and the inner tank and has end walls, side walls and a top wall. Second support elements support the enclosure within the vault, in spaced relation to the base.

At least one access assembly is provided, including a displaceable inner closure on the inner tank, closing an opening into the tank, and a displaceable outer closure on the vault, closing an opening into the vault. The opening in the vault, which is bordered by an upstanding peripheral flange, is superposed over the opening in the inner tank.

In the usual configuration, the tank is of generally cylindrical or rectangular configuration and the enclosure is of generally rectangular configuration. Preferably, the base is a substantially planar concrete pad. Desirably, a flexible gasket is disposed between the vault and the base; and at least one lifting ring is provided on the top wall of the vault.

DETAILED DESCRIPTION OF THE PREFERRED EMBODIMENTS

Figure 1:
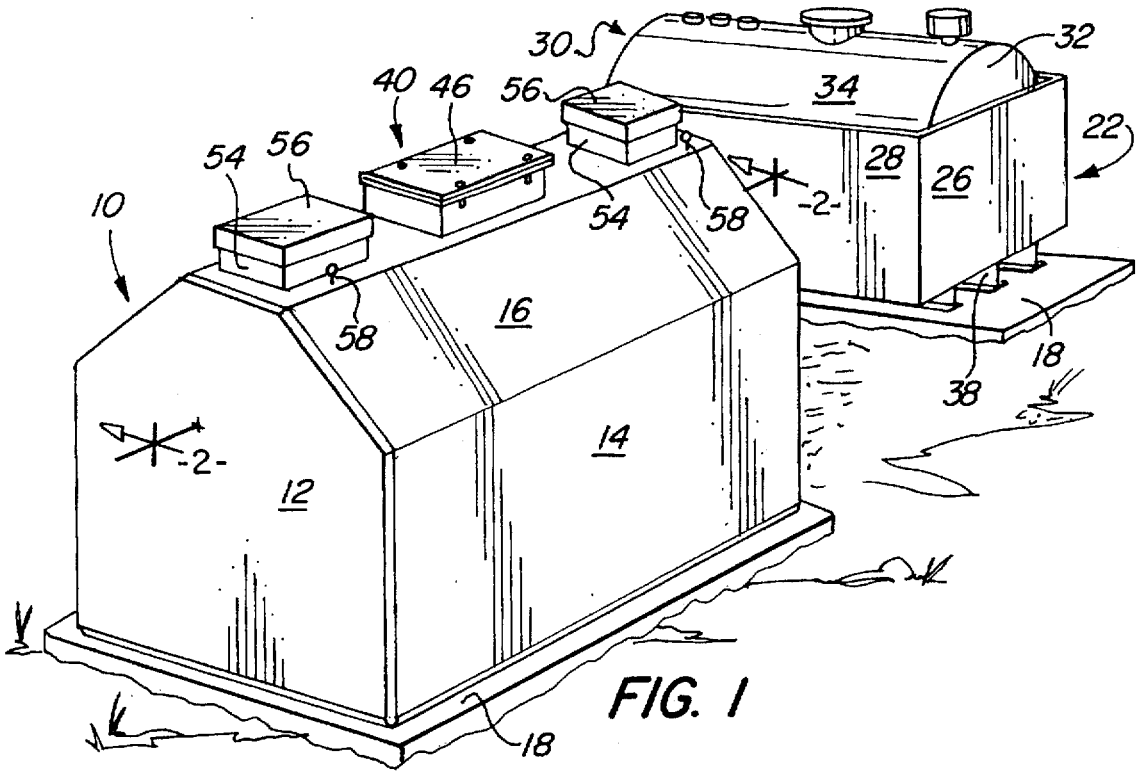
FIG. 1 is a perspective view of two identical liquid storage tank installations embodying the present invention, with the vault of one of the tank installations removed.
Figure 2:
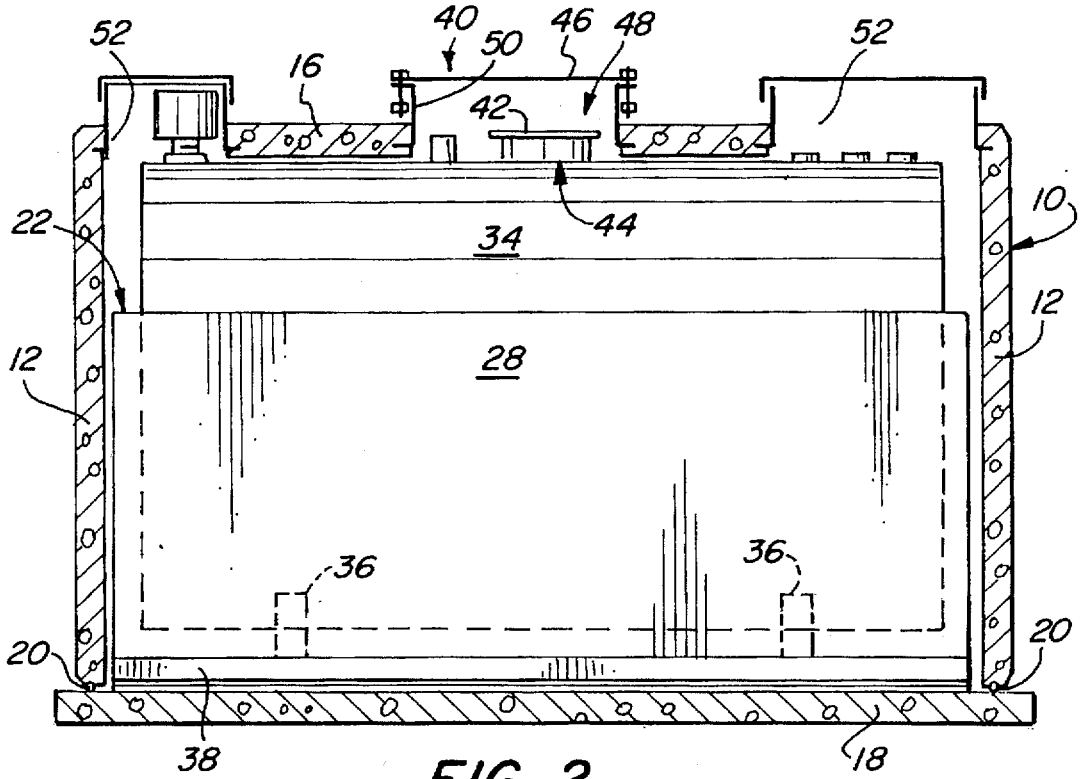
FIG. 2 is a transverse sectional view of the complete tank installation of FIG. 1.
Figure 3:
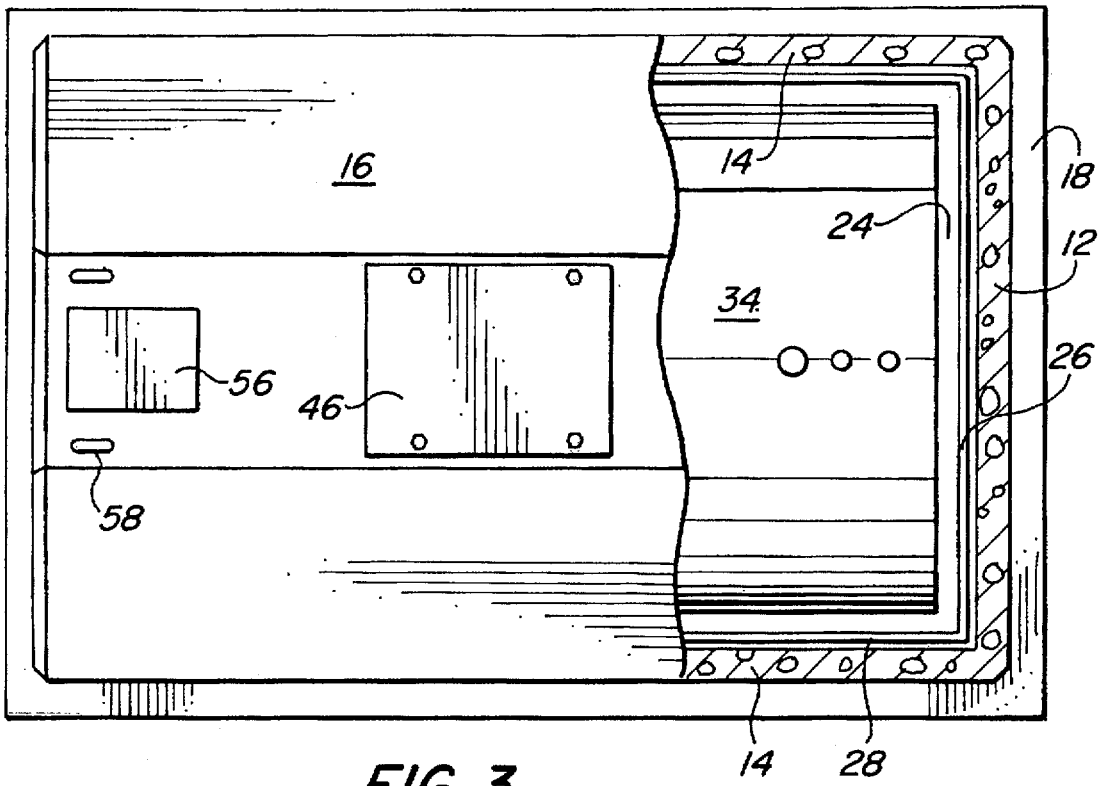
FIG. 3 is a top plan view of the complete tank installation of FIG. 1, with a portion of the vault broken away.
Figure 4:
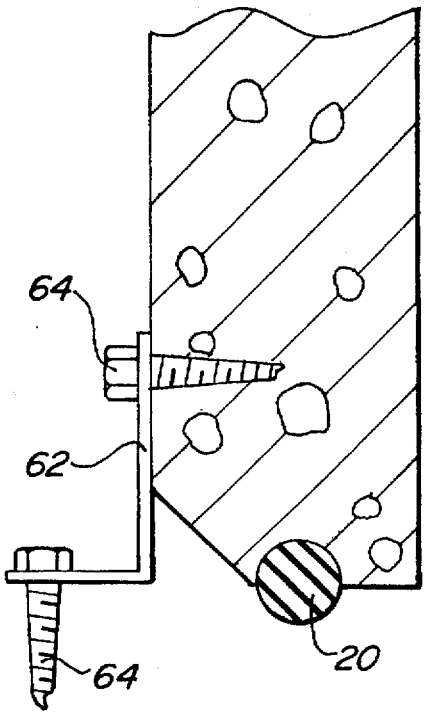
FIG. 4 is an enlarged, fragmentary, cross-sectional view of the bottom portion of the vault.

Turning first to FIGS. 1–6, therein illustrated is a secure and environmentally safe liquid holding tank installation embodying the invention and comprising a precast concrete vault 10 having end walls 12, side walls 14 and a top wall 16. The vault 10 rests on a substantially planar base 18 which is preferably a concrete pad, but which may also be made of gravel or packed earth. As best seen in FIG. 4, a flexible gasket 20 is carried by the end walls 12 and side walls 14 of the vault 10, such that the vault 10 rests on the gasket 20 which is compressed against the pad 18 to provide a liquid resistant seal which is intended to prevent or minimize the entry of rain or other environmental moisture into the vault 10, As best seen in FIG. 4, the outer lower edges of the end walls 12 and side walls 14 are beveled. Sealant may be placed in this beveled area after the vault 10 has been emplaced on the base 18.

Within the vault 10 is a rigid enclosure 22 having a base wall 24, end walls 26 and side walls 28. Within the rigid enclosure 22 is an inner tank 30 having end walls 32 and a peripheral wall 34. If desired, inner tank 30 may be double walled. As best seen in FIGS. 2 and 3, the end walls 26 and side walls 28 of the enclosure 22 are spaced outwardly from the end walls 32 and peripheral wall 34 of the inner tank 30 to provide a compartment therebetween which has a volume equal to at least one-half the volume of the inner tank 30 and preferably equal to 110% of the inner tank volume to comply with the normal rules of thumb used by the state and federal environmental protection agencies. Thus, the volume of the compartment is calculated as if the inner tank 30 was not disposed therein. First support elements 36 support the inner tank 30 within the enclosure 22 and advantageously also maintain the inner tank 30 in spaced relation to the enclosure base wall 24, thereby providing a sump around the inner tank 30.

Second support elements 38 support the enclosure 22 within the vault 10, in spaced relation to the base 18.

Figure 6:
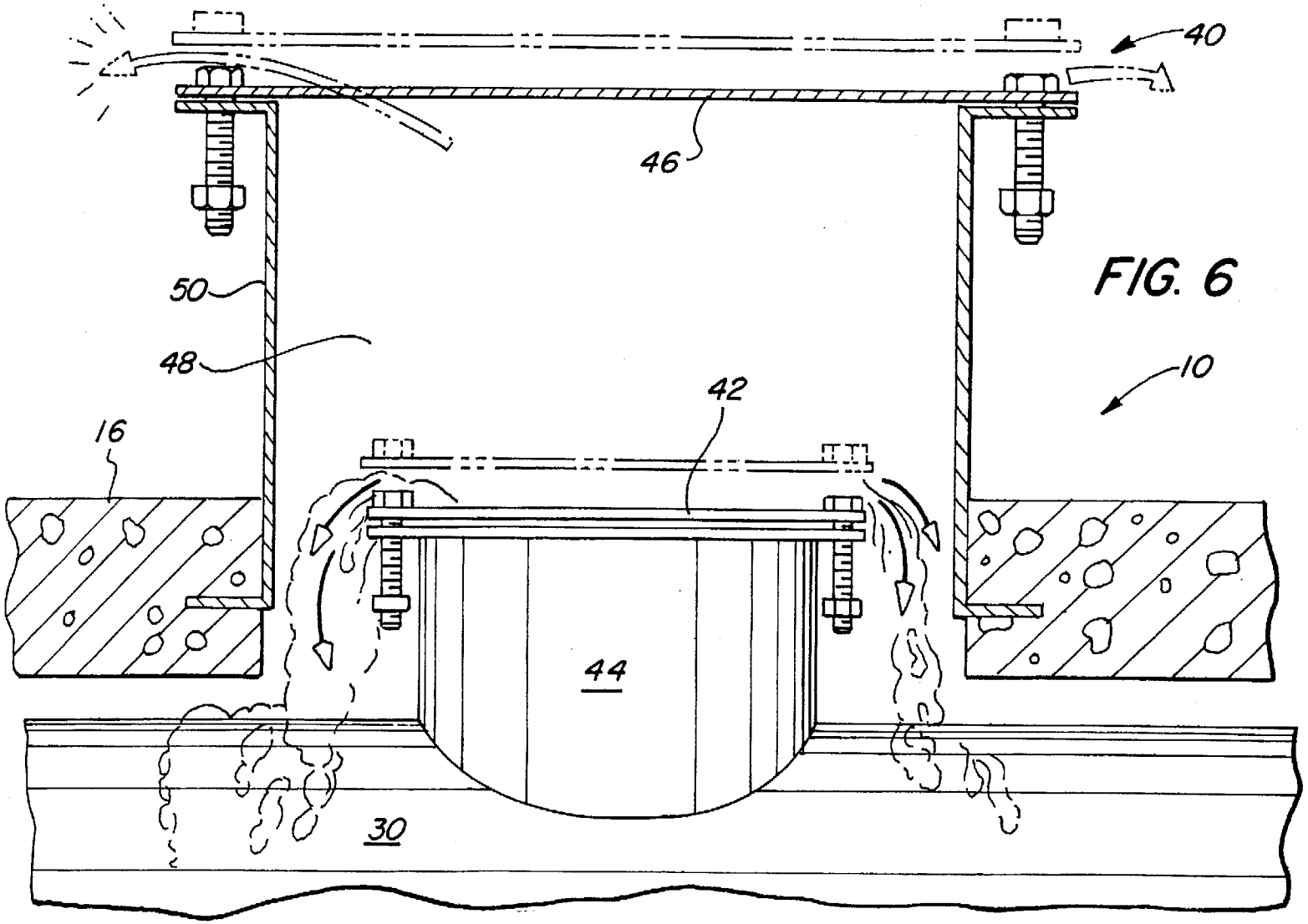
FIG. 6 is an enlarged fragmentary, cross-sectional view of the access assembly of the storage tank installation of FIG. 1.

At least one access assembly 40 is provided in the liquid holding tank. As best seen in FIGS. 2 and 6, the access assembly 40 includes a displaceable inner closure 42, which closes an opening 44 into the inner tank 30, and a displaceable outer closure 46, which closes an opening 48 into the vault 10. The opening 48 into the vault 10 is superposed over the opening 44 into the inner tank 30.

The opening 44 in the vault 10 is bordered by an upstanding peripheral flange 50 on which the outer closure 46 rests.

The flange 50 is intended to prevent the entry of rain or other environmental moisture into the vault 10. The outer closure 46 is secured to the flange 50 by means, such as loosely tightened threaded fasteners, which allow the closure 46 to displace upwardly in response to a substantial increase in the internal pressure of the vault 10, thereby providing emergency venting as illustrated in FIG. 6. Preferably, the opening 44 is of a size to permit entry into the vault 10 of maintenance personnel.

Various other openings 52 are provided in the top wall 16 of the vault. The openings 52 are positioned and configured so as to provide appropriate access to fittings on the inner tank. All of the openings 52 are bordered by upstanding peripheral flanges 54 and are provided with caps 56, the flanges 54 and caps 56 serving to prevent moisture entering the vault 10. Where pipes or conduits extend from the vault 10 through an opening 52, the emerging pipe or conduit is sealed to the peripheral flange 54 so as to exclude moisture. In some instances, it may be possible to combine openings in the vault 10. Such a combined structure is illustrated in FIGS. 1–3 and 6, wherein a vent pipe 57 on the inner tank 30 is closely adjacent to the inner tank opening 44 and emerges from the vault 10 through the same vault opening 48.

Figure 5:
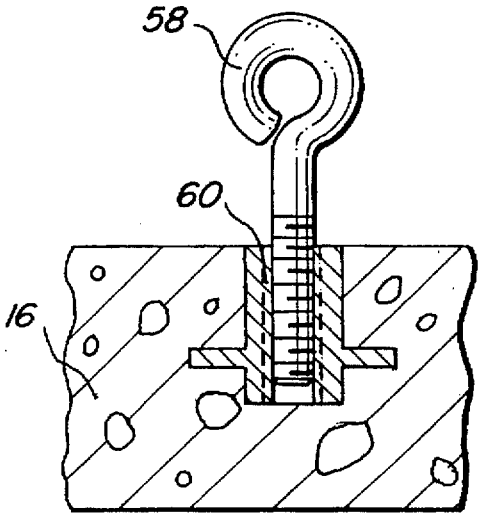
FIG. 5 is an enlarged, fragmentary, cross-sectional view of the top portion of the vault.

Lifting rings 58 are provided in the top wall 16 of the vault 10 to facilitate lifting and placement of the vault 10 with a crane. Although the preferred embodiments of the invention have four lifting rings placed near the corners of the vault, other numbers and arrangements may be utilized. As shown in FIG. 5, the lifting rings 58 are screwed into threaded fittings 60, from which they may be conveniently removed when not in use.

In order to resist unintentional displacement, such as may otherwise result e.g. from vehicle impact or during flooding, the vault 10 is secured to the base 18 by right angled metal brackets 62 and mechanical fasteners 64, as best seen in FIG. 4.

Figure 7:
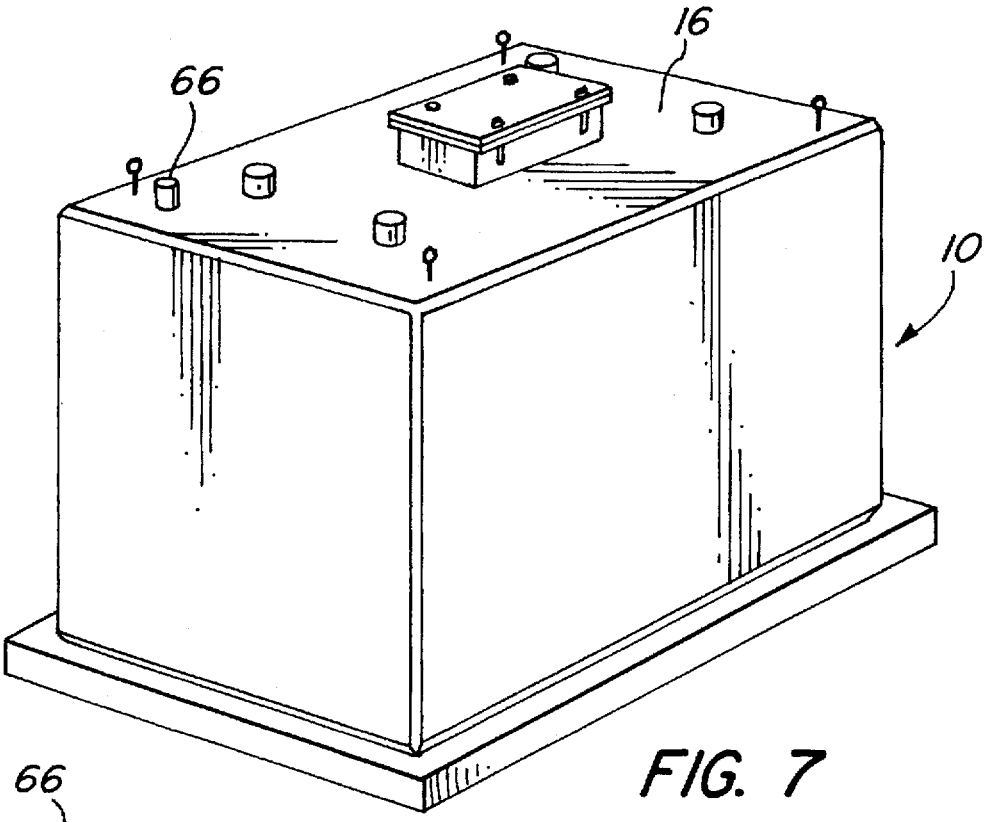
FIG. 7 is a perspective view of another embodiment of the present invention.
Figure 9:
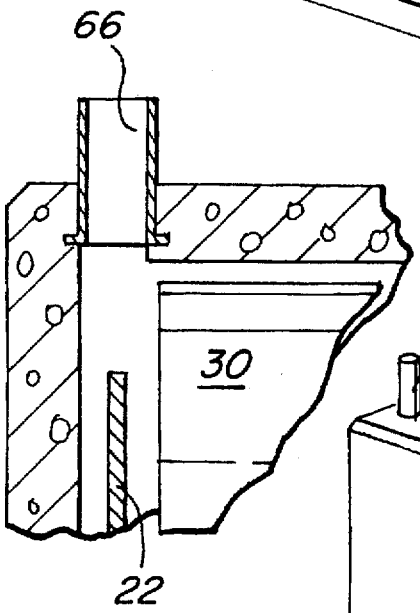
FIG. 9 is an enlarged, fragmentary cross sectional view of an inspection port.
Figure 8:
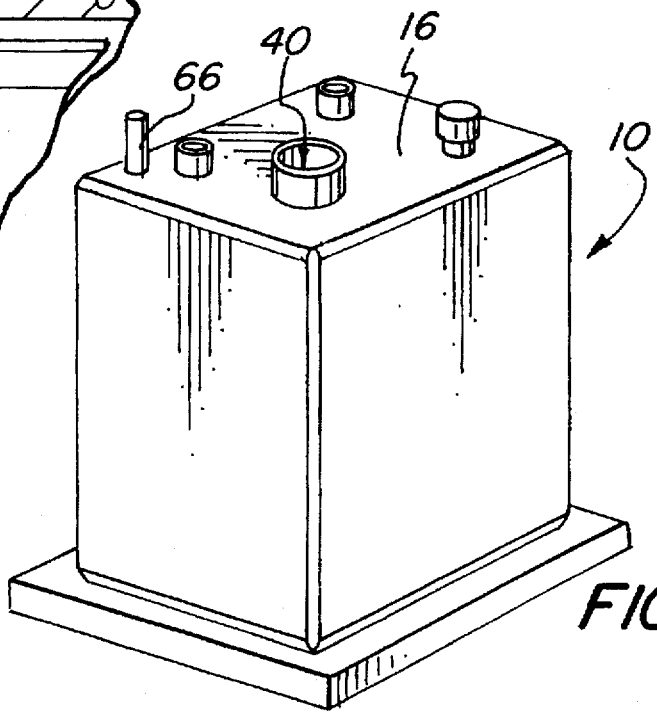
FIG. 8 is a perspective view of yet another embodiment of the present invention.

Turning now to FIGS. 7 and 8, therein illustrated are two further embodiments of the present invention, differing from the previously described embodiment primarily in size and configuration. Both of these embodiments are provided with inspection ports 66 which consist of flanged, capped openings in the top walls 16 of the vaults 10. As illustrated in FIG. 9, the inspection ports 66 are superposed over a portion of the compartment between the enclosure 22 and the inner tank 30 and allow convenient inspection for tank leakage. Provision of an inspection port is especially advantageous in smaller embodiments of the invention, such as that illustrated in FIG. 8, where the access assembly 40 is of a size which limits or precludes access to the compartment.

Thus, it can be seen from the foregoing detailed description and the attached drawings that the tank installation of the present invention is one which may be readily fabricated and which may enjoy extended life. The enclosure contains any leakage or spills from the tank. The vault protects the tank and the enclosure against detrimental external forces while providing access for inspection, maintenance and replacement thereof.

Although the present invention has been described with reference to preferred embodiments, it will be apparent that numerous modifications and variations may be made without departing from the spirit and contemplation thereof, which are intended to be limited in scope only by the appended claims.

Having thus described the invention, what is claimed is:

1. An above ground, secure and environmentally safe liquid holding tank installation comprising:

(a) an inner tank having end walls and a peripheral wall;

(b) a rigid enclosure extending about said inner tank and having a base wall, end walls and side walls, said enclosure end walls and side walls being spaced outwardly from said end walls and peripheral wall of said inner tank to provide a compartment thereabout, said inner tank being supported on said base wall;

(c) a base on which said enclosure is supported;

(d) a five sided precast concrete vault removably seated on said base and enclosing said rigid enclosure and said inner tank, said vault having end walls, side walls and a top wall, the walls of said vault being spaced from the walls of said rigid enclosure and said vault being open at its lower end; and (e) at least one access assembly including a displaceable inner closure on said inner tank removable closing an opening into said tank and a displaceable outer closure on said vault top wall closing an opening into said vault, said opening in said vault being encircled by an upstanding peripheral flange and being superposed over said opening in said inner tank.

2. The liquid holding tank installation of claim 1, wherein said base wall of said enclosure is spaced from said inner tank to provide a sump about said inner tank.

3. The liquid holding tank installation of claim 1, wherein said inner and outer closures are loosely secured to said inner tank and said vault respectively so as to provide an emergency vent from said inner tank to the atmosphere.

4. The liquid holding tank installation of claim 1, wherein said inner tank is of generally cylindrical configuration and said enclosure is of generally rectangular configuration.

5. The liquid holding tank installation of claim 1, wherein said compartment defined between said inner tank and said enclosure has a volume at least equal to one-half that of said inner tank.

6. The liquid holding tank installation of claim 1, wherein the bottom outer edges of said vault side walls and end walls are beveled.

7. The liquid holding tank installation of claim 1, wherein said base wall of said enclosure is spaced from said base on which said enclosure is supported.

8. The liquid holding tank installation of claim 1, wherein said base is a concrete pad.

9. The liquid holding tank installation of claim 1, further comprising sealing means for providing a water resistant seal between said vault and said base.

10. The liquid holding tank installation of claim 1, further comprising at least one metal bracket fixed to said vault and said base.

11. The liquid holding tank installation of claim 1, further comprising at least one lifting ring on said top wall of said vault.

12. The liquid holding tank installation of claim 9, wherein said sealing means comprises a flexible gasket disposed between said vault and said base.

13. The liquid holding tank installation of claim 11, wherein said at least one lifting ring is removable.

14. The liquid holding tank installation of claim 1, further comprising an opening in said vault top wall superposed compartment.

* * * * *